US008174193B2

(12) United States Patent
Shido et al.

(10) Patent No.: US 8,174,193 B2
(45) Date of Patent: May 8, 2012

(54) VEHICULAR DISCHARGE LAMP

(75) Inventors: Masaya Shido, Shizuoka (JP); Masato Harazaki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 80 days.

(21) Appl. No.: 12/782,870

(22) Filed: May 19, 2010

(65) Prior Publication Data

US 2010/0295449 A1 Nov. 25, 2010

(30) Foreign Application Priority Data

May 20, 2009 (JP) ..... 2009-122319

(51) Int. Cl.
*H01J 17/18* (2006.01)

(52) U.S. Cl. ..... 313/623; 313/624; 313/625; 313/626

(58) Field of Classification Search ..... 313/25, 313/623–626
See application file for complete search history.

(56) References Cited

U.S. PATENT DOCUMENTS

2007/0296339 A1 12/2007 Grundmann et al.

FOREIGN PATENT DOCUMENTS

DE 102005013759 A1 9/2006
JP 2003-331789 A 11/2003
JP 2008-181844 A 8/2008

OTHER PUBLICATIONS

Extended European search report dated Jan. 20, 2011, issued in corresponding European Patent Application No. 10162983.0 (10 pages).

*Primary Examiner* — Vip Patel
(74) *Attorney, Agent, or Firm* — Sughrue Mion, PLLC

(57) ABSTRACT

A vehicular discharge lamp includes a pair of electrodes including sealed portions sealed in a pair of pinch seal portions of a light emitting tube, wherein each of the sealed portions is segmented into: a first intermediate region positioned in the middle of the electrode in an axial direction; two end regions configured as both end portions of the sealed portion in the axial direction; and two second intermediate regions positioned between the first intermediate region and the end regions, respectively, wherein concave or convex fabrication portions are formed in the second intermediate regions, and wherein a ratio of formation area of the fabrication portions to an area of an outer peripheral surface of the first intermediate region is set to be smaller than that of the formation area of the fabrication portions to an area of outer peripheral surfaces of the second intermediate regions.

5 Claims, 8 Drawing Sheets

FIG. 5A

END REGION (OF WELDED PORTION): 1.0mm
FORMATION RANGE OF FABRICATION PORTIONS:
FIRST INTERMEDIATE REGION) + (SECOND INTERMEDIATE REGIONS) (4.0mm IN TOTAL)

| END REGION (OF WELDED PORTION) | 0.3mm | 0.5mm | 1.0mm | 1.2mm |
|---|---|---|---|---|
| ELECTRODE LEAK | - | - | - | 20h. |
| FOIL LEAK | 690h.<br>910h.<br>990h. | 830h.<br>940h.<br>940h. | 850h.<br>970h.<br>1030h. | 820h.<br>900h. |
| DETERMINATION | X | O | O | X |

FIG. 5B

END REGION (OF PROTRUDING PORTION): 1.0mm
FORMATION RANGE OF FABRICATION PORTIONS:
FIRST INTERMEDIATE REGION) + (SECOND INTERMEDIATE REGIONS) (4.0mm IN TOTAL)

| END REGION (OF PROTRUDING PORTION) | 0.3mm | 0.5mm | 1.0mm | 1.2mm |
|---|---|---|---|---|
| ELECTRODE LEAK | - | - | - | 130h. |
| FOIL LEAK | 710h.<br>990h.<br>1100h. | 930h.<br>940h.<br>1010h. | 850h.<br>970h.<br>1030h. | 890h.<br>970h. |
| DETERMINATION | X | O | O | X |

FIG. 5C

END REGION (OF PROTRUDING PORTION AND WELDED PORTION): RESPECTIVE 0.5mm
FORMATION RANGE OF FABRICATION PORTIONS: SECOND INTERMEDIATE REGION

| REGION WHERE FABRICATION PORTION IS NOT FORMED | NONE | 0.5mm | 1.0mm | 1.2mm |
|---|---|---|---|---|
| ELECTRODE LEAK | - | - | - | 15h. |
| FOIL LEAK | 750h.<br>870h.<br>900h. | 890h.<br>900h.<br>950h. | 840h.<br>900h.<br>920h. | 830h.<br>1040h. |
| DETERMINATION | X | O | O | X |

FIG. 5D

END REGION (OF PROTRUDING PORTION AND WELDED PORTION): RESPECTIVE 1.0mm
FORMATION RANGE OF FABRICATION PORTIONS:
(FIRST INTERMEDIATE REGION) + (SECOND INTERMEDIATE REGIONS) (4.0mm IN TOTAL)

| LENGTH OF ELECTRODE | 7.5mm | 8.0mm | 8.5mm |
|---|---|---|---|
| ELECTRODE LEAK | - | - | - |
| FOIL LEAK | 620h.<br>720h.<br>910h. | 850h.<br>970h.<br>1030h. | 860h.<br>1080h.<br>1100h. |
| DETERMINATION | X | O | O |

VEHICULAR DISCHARGE LAMP

CROSS REFERENCE TO RELATED APPLICATION(S)

The present disclosure relates to the subject matters contained in Japanese Patent Application No. 2009-122319 filed on May 20, 2009, which are incorporated herein by reference in its entirety.

FIELD

The present invention relates to a vehicular discharge lamp and to a technical field that forms concave or convex fabrication portions at a part of an electrode, and prevents generation of a leak by changing formation state of the fabrication portions according to formation positions.

BACKGROUND

For example, there is provided a vehicle headlamp where an incandescent lamp (incandescent bulb) or a halogen lamp (halogen bulb) is used as a light source, a vehicle headlamp where a discharge lamp (discharge bulb) is used as a light source, and a vehicle headlamp where a light emitting diode (LED) is used as a light source.

Since light intensity and brightness of a discharge lamp is larger than those of an incandescent lamp, a halogen lamp, and light emitting diode, it may be possible to obtain an advantage of achieving a headlamp having a large light intensity in the case of the vehicle headlamp where a discharge lamp is used as a light source.

A discharge lamp has a double-tube structure where a light emitting tube in which a pair of electrodes is held and gases such as noble gases or metal halides are sealed is disposed in an outer tube. The light emitting tube includes a light emitting portion where discharge occurs, and a pair of pinch seal portions that is provided on the opposite sides of the light emitting portion and is made of a material such as quartz glass. The light emitting portion is blocked from the outside by the pinch seal portions. The light emitting portion is a portion where arcs are generated during the occurrence of discharge, and has a diameter larger than the diameter of the pinch seal portion.

One end portions of the pair of electrodes protrude into the light emitting portion, and the other end portions thereof are sealed in the pinch seal portions, respectively. The other end portions of the pair of electrodes are welded to molybdenum foils sealed in the pair of pinch seal portions, respectively.

In the discharge lamp, a predetermined starting voltage is applied to the pair of electrodes held in the light emitting tube, so that discharge occurs in the light emitting portion of the light emitting tube. Accordingly, the discharge lamp starts to be turned on.

The discharge lamp is pinch-sealed by molybdenum foils in order to block completely the light emitting tube from the outside.

The molybdenum foil is formed of a very thin foil in order to minimize stress generated due to the difference between coefficients of thermal expansion of the quartz glass of the pinch seal portion and the molybdenum foil which is caused by temperature change occurring due to the repeated turning on/off of the discharge lamp.

However, if the discharge lamp is repeatedly turned on/off several tens of thousands times, the molybdenum foil and quartz glass are gradually separated due to stress (cracks are generated). Eventually, non-lighting due to the leakage occurs (the life of the discharge lamp comes to an end).

The following two methods are generally used to prevent the non-lighting caused by the molybdenum foil and to lengthen the life of the molybdenum foil.

(1) A method of increasing the adhesion between the molybdenum foil and quartz glass.

(2) A method of making the molybdenum foil distant from the light emitting portion, that is, a method of increasing the length of the electrode.

However, in the method (1) of increasing the adhesion between the molybdenum foil and quartz glass, the adhesion between the electrode and quartz glass is also increased. For this reason, the difference between the coefficients of thermal expansion of the electrode of the pinch seal portion is caused by temperature change occurring due to the repeated turning on/off of the discharge lamp. As a result, stress is generated and cracks are generated in the pinch seal portions around the electrode, so that the non-lighting due to the leakage occurs.

In recent years, a discharge lamp where mercury is not sealed in a light emitting tube has been widely used in consideration of the environment. However, since mercury is not sealed in this discharge lamp, a tube voltage is not increased. As a result, tube current is increased, and the outer diameter of the electrode should be increased in order to cope with the increase of tube current. For this reason, stress, which is generated between the electrode and the pinch seal portion, is further increased, so that there is a high possibility that cracks are generated in the pinch seal portion, which leads to occurrence of the non-lighting due to the leakage.

In contrast, if the adhesion between the molybdenum foil and quartz glass is decreased, the life of the molybdenum foil is reduced and a gap is formed between the electrode and the quartz glass. Accordingly, there is also a possibility that non-lighting occurs due to the leakage from the gap.

Further, in the method (2) of making the molybdenum foil distant from the light emitting portion, that is, the method of increasing the length of the electrode, the length of the electrode adhering to the quartz glass is increased. Accordingly, stress, which is generated between the electrode and the pinch seal portion, is increased, so that cracks are generated in the pinch seal portion around the electrode, which leads to occurrence of the non-lighting due to the leakage.

In order to prevent the generation of a leak from the electrode that is caused by the cracks, the following discharge lamp has been proposed as a discharge lamp in the related art (for example, see Patent Document 1). In this discharge lamp, very small gaps are formed between an electrode and an inner surface of a pinch seal portion by a metal wire wound on the electrode in the shape of a coil, and a sealing property is secured with appropriate adhesion between the electrode and quartz glass. Accordingly, non-lighting due to the leakage is prevented and the life of the discharge lamp is lengthened.

An example of such configuration is disclosed in JP-A-2008-181844.

However, the discharge lamp disclosed in the publication, JP-A-2008-0181844, metal halides (iodide) sealed in the light emitting portion permeate into the gaps, which are formed between the electrode and the inner surface of the pinch seal portion, in the form of a gas due to high pressure at the time of turning-on/off of the discharge lamp, and reach the molybdenum foil. If the iodide reaches the molybdenum foil, the iodide is solidified at the time of the turning-off of the discharge lamp. For this reason, stress, which makes the molybdenum foil separate from the pinch seal portion, is generated, and the leak of molybdenum foil from a sealed portion (foil leak) occurs due to the decrease in the adhesion between the pinch seal portion and the molybdenum foil. As a result, non-lighting occurs and the life of the discharge lamp is decreased.

SUMMARY

One of objects of the present invention is to provide a vehicular discharge lamp that prevents the generation of a leakage.

According to an aspect of the invention, there is provided a vehicular discharge lamp including: an outer tube; a light emitting tube disposed in the outer tube and is made of quartz glass; and a pair of electrodes disposed in the light emitting tube, wherein the light emitting tube includes: a light emitting portion in which mercury-free encapsulated gas comprising noble gas and metal halides is sealed; and a pair of pinch seal portions connected to the light emitting portion on the opposite sides of the light emitting portion, each of the pinch seal portions being sealed with a molybdenum foil, wherein the pair of electrodes includes: sealed portions sealed in the pair of pinch seal portions of the light emitting tube; protruding portions connected to one ends of the respective sealed portions and protrude into the light emitting portion of the light emitting tube; and welded portions connected to the other ends of the respective sealed portions and are welded to the respective molybdenum foils, wherein each of the sealed portions is segmented into: a first intermediate region positioned in the middle of the electrode in an axial direction; two end regions configured as both end portions of the sealed portion in the axial direction; and two second intermediate regions positioned between the first intermediate region and the end regions, respectively, wherein concave or convex fabrication portions are formed in the second intermediate regions, and wherein a ratio of formation area of the fabrication portions to an area of an outer peripheral surface of the first intermediate region is set to be smaller than that of the formation area of the fabrication portions to an area of outer peripheral surfaces of the second intermediate regions.

BRIEF DESCRIPTION OF THE DRAWINGS

A general configuration that implements the various feature of the invention will be described with reference to the drawings. The drawings and the associated descriptions are provided to illustrate embodiments of the invention and not to limit the scope of the invention.

FIGS. 5A-5D show tables that display the results of a test for measuring the generation time of an electrode leak and a foil leak of the discharge lamp.

DETAILED DESCRIPTION OF THE EMBODIMENT(S)

Figure 1:
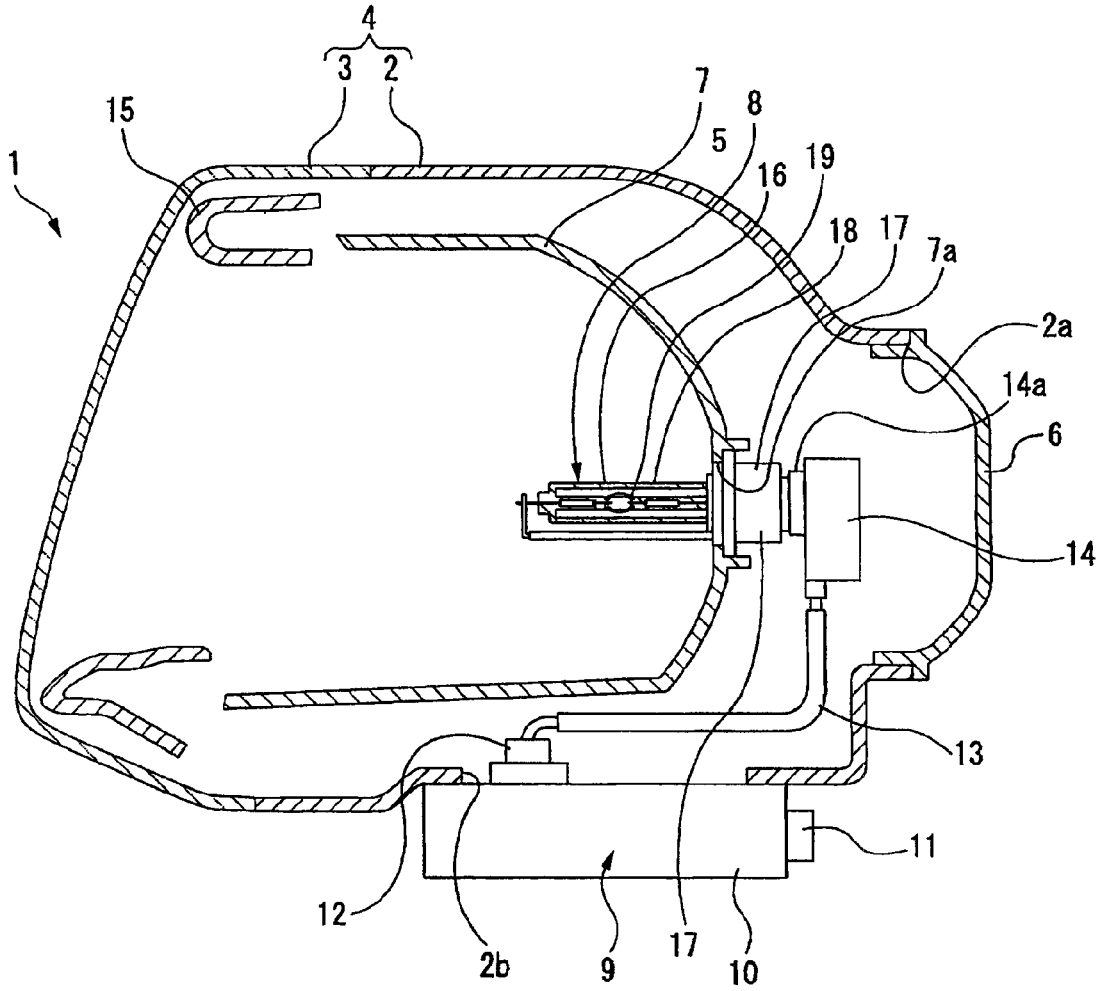
FIG. 1 is a schematic cross-sectional view of a vehicle headlamp as an example of a vehicular discharge lamp according to an embodiment of the invention.

A vehicular discharge lamp according to an embodiment of the invention will be described below with reference to accompanying drawings. The scope of the claimed invention should not be limited to the examples illustrated in the drawings and those described below. A vehicle headlamp is provided with a vehicular discharge lamp.

The vehicle headlamps 1 are disposed so as to be mounted on left and right end portions of a front end portion of a vehicle body.

As shown in FIG. 1, the vehicle headlamp 1 includes a lamp housing 2 that has a recess opened toward the front side and a cover 3 that closes an opening of the lamp housing 2, and a lamp outer case 4 is formed of the lamp housing 2 and the cover 3. An inner space of the lamp outer case 4 is formed as a lamp chamber 5.

An insertion hole 2*a*, which passes through the lamp housing in a front-and-rear direction, is formed in a rear end portion of the lamp housing 2, and the insertion hole 2*a* is closed by a back cover 6. A positioning hole 2*b*, which passes through the lamp housing in an up-and-down direction, is formed in a lower end portion of the lamp housing 2.

In the lamp chamber 5, a reflector 7 is supported by an optical axis adjustment mechanism (not shown) so as to be tiltable. A mounting hole 7*a*, which passes through the reflector in the front-and-rear direction, is formed in a rear end portion of the reflector 7.

A discharge lamp (vehicular discharge lamp) 8 is mounted on the mounting hole 7*a* of the reflector 7.

A ballast 9 is mounted on the positioning hole 2*b* of the lamp housing 2. The ballast 9 is provided with a lighting circuit (not shown) that is received in a case body 10. An input connector 11 is provided on the outer peripheral surface of the case body 10, and an output connector 12 is provided on the upper surface of the case body 10. The input connector 11 is connected to a power supply circuit (not shown).

The output connector 12 is connected to a starting device 14 through a power supply cord 13, and a connector 14*a* of the starting device 14 is connected to a socket (to be described below) of the discharge lamp 8.

A power supply voltage of the power supply circuit is increased by a lighting circuit of the ballast 9 and is converted into a lighting voltage (starting voltage), which is a high AC voltage, through orthogonal transformation. Then, the lighting voltage is applied to the discharge lamp 8 through the power supply cord 13 and the starting device 14 and discharge starts, so that the discharge lamp 8 is turned on.

An extension 15, which shields a part of each component disposed in the lamp chamber 5, is provided in the lamp chamber 5. A shade (not shown), which blocks a part of the light emitted from the discharge lamp 8, is disposed in the lamp chamber 5.

Figure 2:
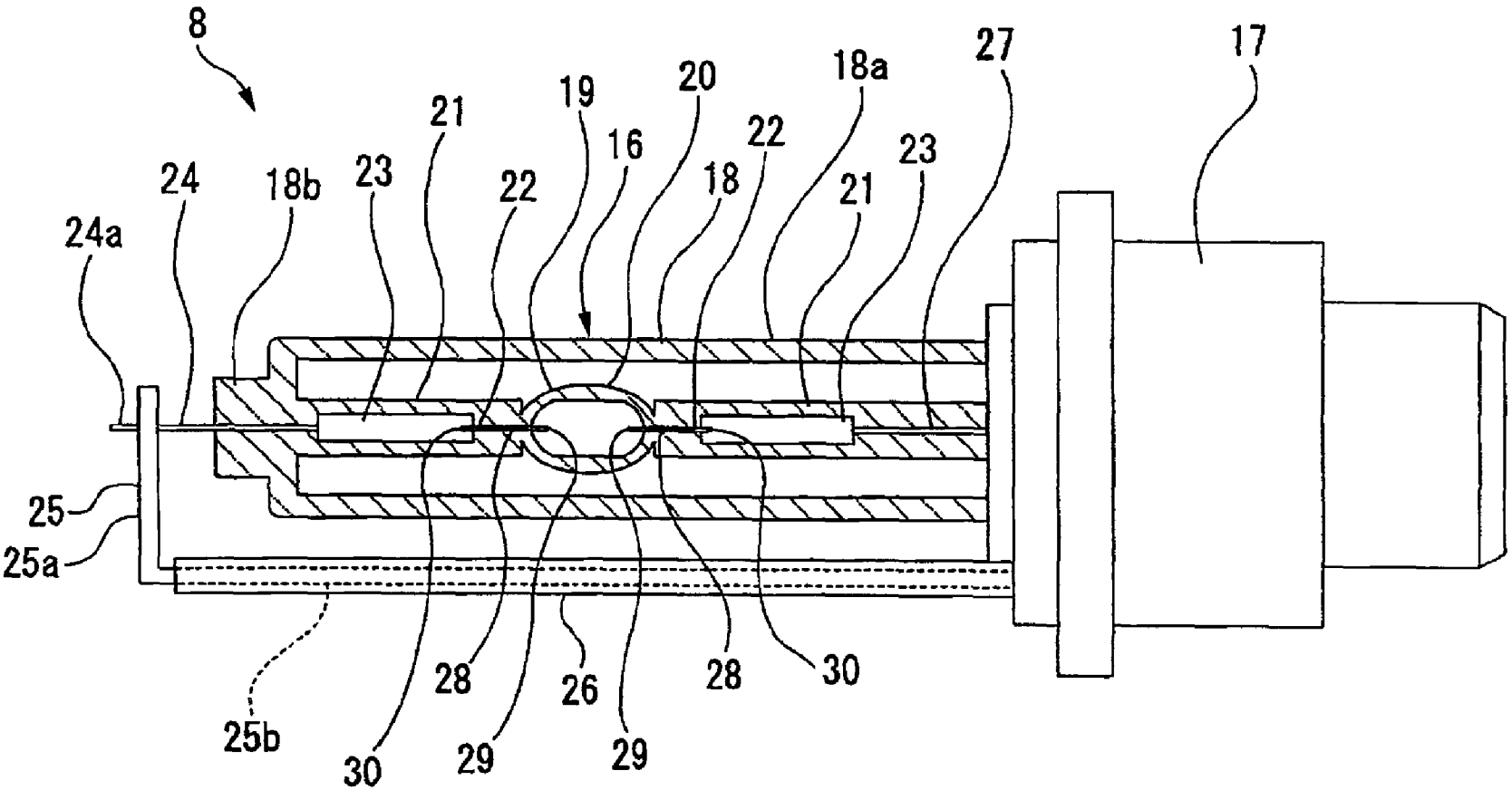
FIG. 2 is an enlarged side view of the discharge lamp of which a part is shown by a cross section.

The discharge lamp 8 is formed so that a main body 16 is connected to a socket 17 (see FIG. 2).

The main body 16 includes an outer tube 18 and a light emitting tube 19 disposed in the outer tube 18. The outer tube 18 and the light emitting tube 19 are made of quartz glass and are formed integrally with each other.

The outer tube 18 includes a closing portion 18*a* that covers the light emitting tube 19 and the like, and a holding portion 18*b* that protrudes forward from a front end portion of the closing portion 18*a*.

The light emitting tube 19 includes a light emitting portion 20 that has, for example, an internal volume of 22 μl and an inner diameter of 2.6 mm, and pinch seal portions 21 and 21 that are connected to front and rear ends of the light emitting portion 20, respectively. Each of the pinch seal portions 21 and 21 is formed substantially in the shape of a cylinder extending in the front-and-rear direction, and the outer diameter of each of the pinch seal portions is smaller than that of the light emitting portion 20.

For example, NaI, $ScI_3$, $ScBr_3$, InI, and $ZnI_2$ as metal halides are sealed in the light emitting portion 20 at ratio (w %) of 58:12.8:20:0.2:9, respectively, with a weight of 0.3 mg. Xe as a noble gas is sealed in the light emitting portion with a pressure of 15.5 atmospheres. Meanwhile, mercury is not sealed in the light emitting portion 20.

Electrodes 22 and 22 are held in the pinch seal portions 21 and 21, respectively, with a gap of, for example, 4.2 mm therebetween. Each of the electrodes is formed in the shape of a substantially round shaft elongated in the front-and-rear direction, contains, for example, 0.1% of sodium oxide, and has a diameter of 0.3 to 0.4 mm and the entire length of 6 to 8 mm.

Molybdenum foils 23 and 23 are sealed in the pinch seal portions 21 and 21, respectively. Each of the molybdenum foils has, for example, a width of 1.5 mm and a thickness of 20 μm. The electrodes 22 and 22 are welded to one end portions of the molybdenum foils 23 and 23, respectively.

A first lead wire 24 is connected to a front end portion of the molybdenum foil 23 that is positioned on the front side. The first lead wire 24 protrudes forward from the front pinch seal portion 21 of the light emitting tube 19, passes through the holding portion 18*b*, and protrudes outside the outer tube 18. A protruding portion of the first lead wire forms a connecting portion 24*a*. The connecting portion 24*a* of the first lead wire 24 is connected to an external lead wire 25 by welding.

The external lead wire 25 includes a vertical portion 25*a* that extends in an up-and-down direction, and a horizontal portion 25*b* that is connected to a lower end of the vertical portion 25*a* and extends in the front-and-rear direction. An upper end portion of the vertical portion 25*a* is connected to the connecting portion 24*a* of the first lead wire 24, and a rear end portion of the horizontal portion 25*b* is connected to a first connection terminal (not shown) provided at the socket 17.

An insulating sleeve 26 is attached to the horizontal portion 25*b* of the external lead wire 25. The insulating sleeve 26 is made of an insulating material, such as glass or ceramic.

A second lead wire 27, which extends in the front-and-rear direction, is connected to a rear end portion of the molybdenum foil 23 that is positioned on the rear side. The second lead wire 27 protrudes rearward from the rear pinch seal portion 21 of the light emitting tube 19. A rear end portion of the second lead wire 27 is connected to a second connection terminal (not shown) provided at the socket 17.

Figure 3:
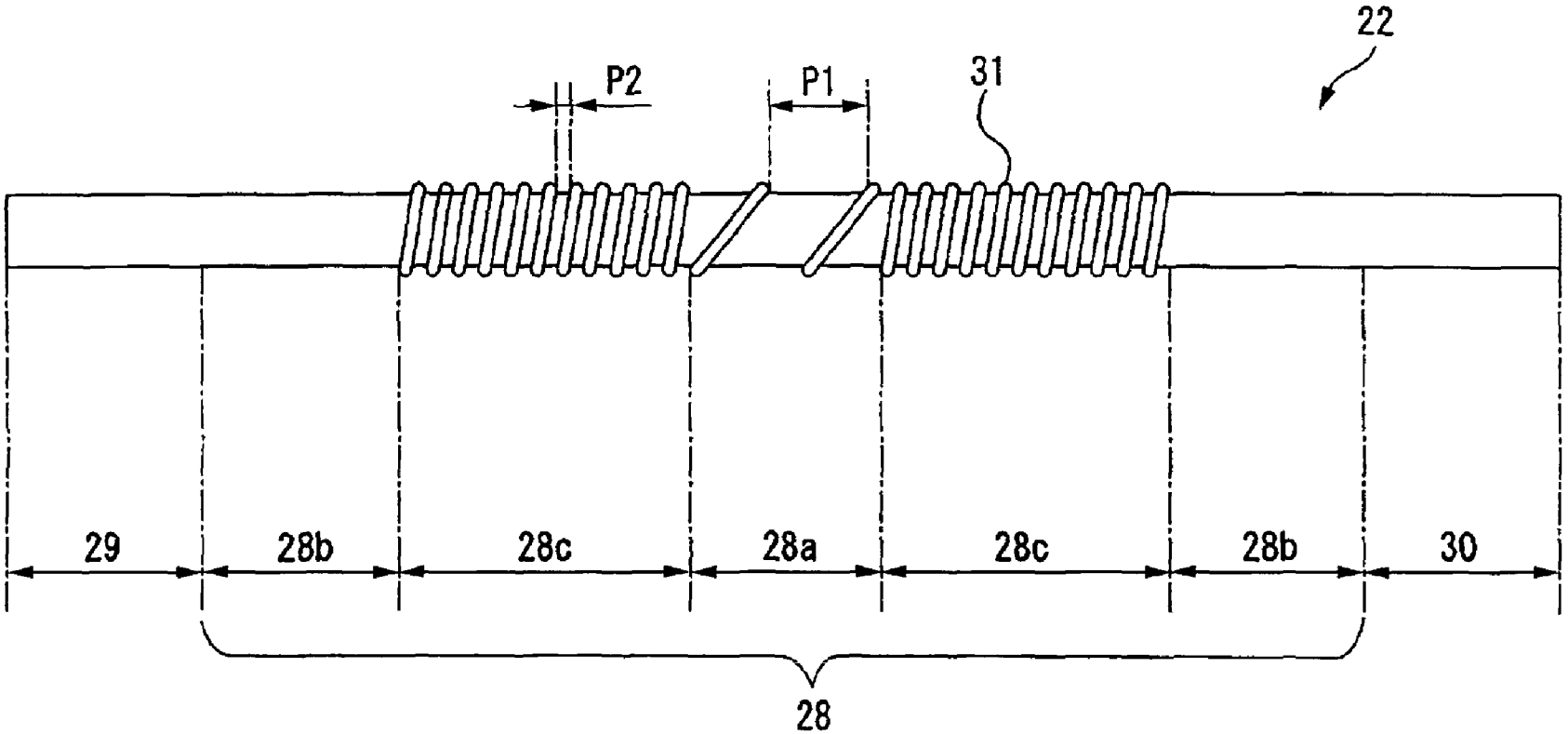
FIG. 3 is an enlarged side view of an electrode.

As shown in FIG. 3, a portion of each electrode 22 except for both end portions thereof in an axial direction forms a sealed portion 28, one end portion of each electrode in the axial direction forms a protruding portion 29 that protrudes into the light emitting portion 20, and the other end portion of each electrode in the axial direction forms a welded portion 30 that is welded to the molybdenum foil 23.

The sealed portion 28 is sealed in the pinch seal portion 21 of the light emitting tube 19. The sealed portion 28 is segmented into a first intermediate region 28*a* that is positioned in the middle of the electrode in an axial direction, two end regions 28*b* and 28*b* that are both end portions of the sealed portion in the axial direction, and two second intermediate regions 28*c* and 28*c* that are positioned between the first intermediate region 28*a* and the end regions 28*b* and 28*b*, respectively.

For example, a metal wire (coil) is spirally wound around on the first intermediate region 28*a* and the second intermediate regions 28*c* and 28*c* of the sealed portion 28, so that convex fabrication portions 31 are formed. The diameter of the metal wire is set to, for example, 0.05 mm. A pitch of the fabrication portions 31, which is a distance between adjacent portions of the metal wire in the axial direction, varies at the first and second intermediate regions 28*a* and 28*c*.

That is, the pitch P1 of the fabrication portions 31 at the first intermediate region 28*a* is larger than the pitch P2 thereof at the second intermediate region 28*c*, and a ratio of the formation area of the fabrication portions 31 to the area of the outer peripheral surface of the first intermediate region 28*a* is smaller than that of the formation area of the fabrication portions 31 to the area of the outer peripheral surface of the second intermediate region 28*c*. Accordingly, the adhesion of the electrode to the pinch seal portion 21 at the first intermediate region 28*a* is higher than that at the second intermediate region 28*c*.

Meanwhile, it may be possible to form the spiral fabrication portions 31 by winding a metal wire on an electrode bar while rotating the electrode bar having the shape of, for example, a round shaft in a circumferential direction and moving the electrode bar in an axial direction. It may be possible to form the electrode 22 easily by forming the fabrication portions 31 in a spiral shape.

Figure 4:
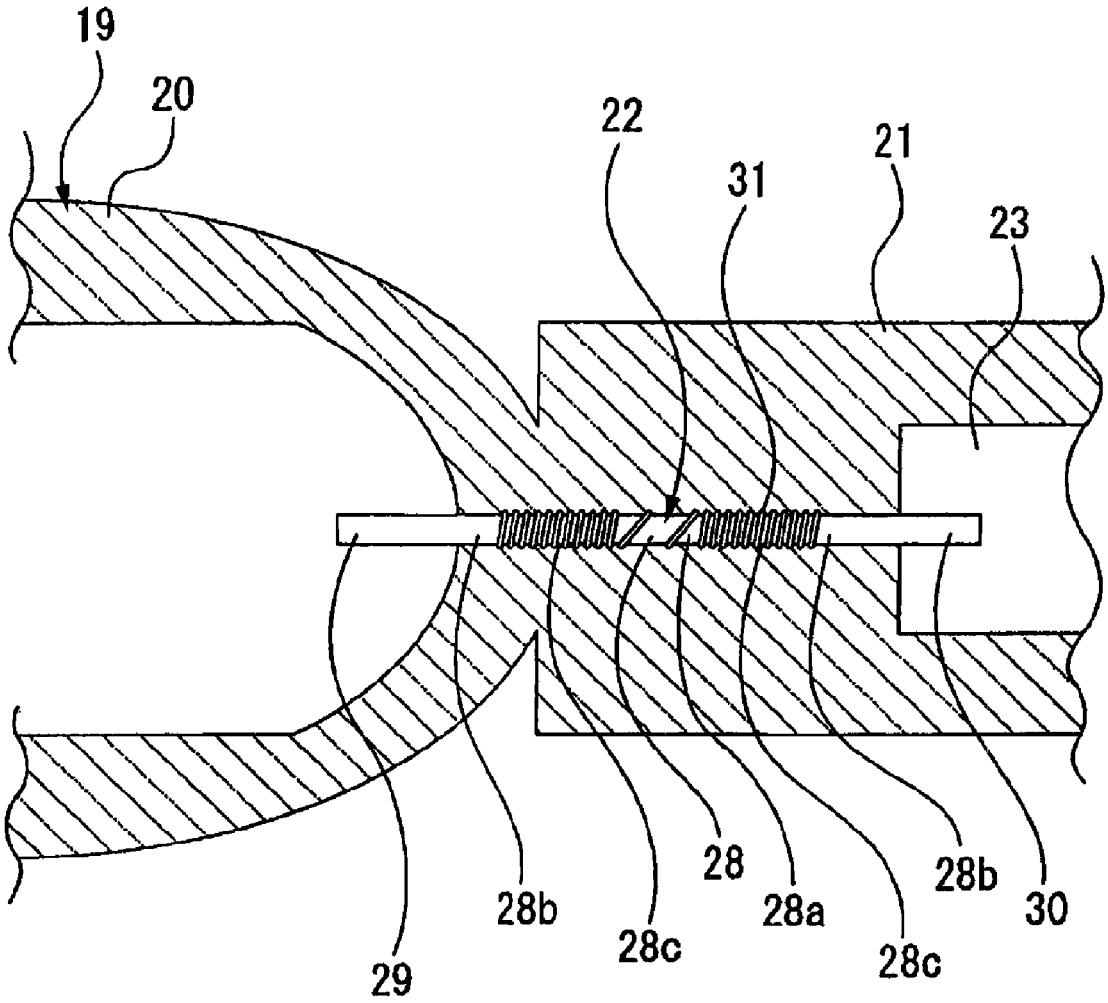
FIG. 4 is an enlarged cross-sectional view showing a part of the discharge lamp.

The electrode 22 has a length of 8 mm or more in an axial direction and a diameter of, for example, 0.35 mm. As shown in FIG. 4, while the electrode 22 is held in the pinch seal portion 21 of the light emitting tube 19, the sealed portion 28 and the welded portion 30 are sealed in the pinch seal portion 21 and the protruding portion 29 protrudes into the light emitting portion 20.

For example, the length of the first intermediate region 28*a* of the sealed portion 28 in the axial direction is in the range of 0.5 to 1.0 mm, and the length of each of the end regions 28*b* and 28*b* in the axial direction is in the range of 0.5 to 1.0 mm.

The electrode 22 is formed as described above, and the convex fabrication portions 31 are formed in the second intermediate regions 28*c* and 28*c* of the sealed portion 28 with a high ratio of the formation area thereof. Accordingly, the adhesion of the second intermediate region to the pinch seal portion 21 is decreased in comparison with a case where a flat electrode without convex fabrication portions adheres to the pinch seal portion 21. Therefore, stress, which is generated at portions of the pinch seal portion 21 that adheres to the second intermediate regions 28*c* and 28*c*, is decreased at the time of the turning-on/off of the discharge lamp 8. Accordingly, cracks that are generated are so-called microcracks and large cracks are scarcely generated at all.

Meanwhile, the convex fabrication portions 31 are formed in the first intermediate region 28*a* of the sealed portion 28 with a low ratio of the formation area thereof. Accordingly, the adhesion of the first intermediate region 28*a* to the pinch seal portion 21 is high and a gap is scarcely formed between the first intermediate region 28*a* and the pinch seal portion 21, so that the metal halides sealed in the light emitting portion 20 scarcely permeate into the molybdenum foil 23.

Further, since the fabrication portions 31 are not formed in the end regions 28*b* and 28*b* that are sealed in the pinch seal portion 21, the adhesion of the end regions 28*b* and 28*b* to the pinch seal portion 21 is significantly increased. Accordingly, gaps are also scarcely formed between the pinch seal portion 21 and the end regions 28*b* and 28*b*, so that the metal halides sealed in the light emitting portion 20 scarcely permeate into the inside of the pinch seal portion 21.

As described above, in the discharge lamp 8, the electrode 22 includes the sealed portion 28, the protruding portion 29, and the welded portion 30, the fabrication portions 31 are formed in the sealed portion 28, and a ratio of the formation area of the fabrication portions 31 to the area of the outer peripheral surface of the first intermediate region 28*a* is set to be smaller than that of the formation area of the fabrication portions 31 to the area of the outer peripheral surfaces of the second intermediate regions 28*c* and 28*c*.

Accordingly, the metal halides scarcely permeate into the molybdenum foil 23 due to the high adhesion between the first intermediate region 28*a* and the pinch seal portion 21, so that it may be possible to prevent a foil leak. It may be possible to prevent a foil leak due to the low adhesion between the second intermediate regions 28*c* and 28*c* and the pinch seal portion 21. It may be possible to stabilize the turning-on state of the discharge lamp 8 and to lengthen the life of the discharge lamp through the prevention of the generation of a leak.

Further, it may be possible to improve an advantage of preventing the generation of a foil leak due to the high adhesion of the end regions 28*b* and 28*b* of the sealed portion 28 to the pinch seal portion 21.

Meanwhile, in the electrode 22, it is preferable that the middle of the first intermediate region 28*a* in the axial direction corresponds to the middle of the electrode 22 in the axial direction, the lengths of the second intermediate regions 28*c* and 28*c* in the axial direction be set to be equal to each other, and the lengths of the end regions 28*b* and 28*b* in the axial direction be set to be equal to each other.

Since the electrode 22 is formed in this way, the electrode 22 is symmetrical in the axial direction and it is not necessary to control the direction of assembly of the electrode in relation to the light emitting tube 19 at the time of assembly. Accordingly, it may be possible to improve the assembling property and to facilitate manufacturing control.

The results of a test, which measures the generation time of an electrode leak and a foil leak of the discharge lamp 8, will be described below (also refer to FIGS. 5A-5D). This test is an accelerated life test that repeatedly turns on and off the discharge lamp where a turning-on state for 3 minutes and a turning-off state for 4 minutes are performed as one cycle. It was determined on the basis of 800 hours whether the results of the test are good or not. Three samples (electrodes) having a length of 8.0 mm were employed in the test.

In each table of FIG. 5, an "electrode leak" means time (lifetime) taken until the discharge lamp 8 is not turned on due to the generation of a leak from an electrode and a "foil leak" means time (lifetime) taken until the discharge lamp 8 is not turned on due to the generation of a leak from a molybdenum foil.

FIG. 5A shows the results of the measurement of the generation time of an electrode leak and a foil leak when the length of the end region 28*b* corresponding to the protruding portion 29 of the electrode 22 is changed.

The measurement has been performed while the length of the end region 28*b* corresponding to the protruding portion 29 is changed when the length of the end region 28*b* corresponding to the welded portion 30 is set to 1.0 mm and a metal wire having a diameter of 0.05 mm is wound on all (4.0 mm) of the first intermediate region 28*a* and the second intermediate regions 28*c* and 28*c* with a pitch of 0.15 mm.

When the length of the end region 28*b* corresponding to the protruding portion 29 is 0.3 mm, there is a sample of which the generation time of a "foil leak" does not reach 800 hours. When the length of the end region 28*b* corresponding to the protruding portion 29 is 1.2 mm, there is a sample of which the generation time of an "electrode leak" does not reach 20 hours. Accordingly, a good result has not been obtained in either case.

Meanwhile, when the length of the end region 28*b* corresponding to the protruding portion 29 is 0.5 or 1.0 mm, good results have been obtained for both an "electrode leak" and a "foil leak".

FIG. 5B shows the results of the measurement of the generation time of an electrode leak and a foil leak when the length of the end region 28*b* corresponding to the welded portion 30 of the electrode 22 is changed.

The measurement has been performed while the length of the end region 28*b* corresponding to the welded portion 30 is changed when the length of the end region 28*b* corresponding to the protruding portion 29 is set to 1.0 mm and a metal wire having a diameter of 0.05 mm is wound on all (4.0 mm) of the first intermediate region 28*a* and the second intermediate regions 28*c* and 28*c* with a pitch of 0.15 mm.

When the length of the end region 28*b* corresponding to the welded portion 30 is 0.3 mm, there is a sample of which the generation time of a "foil leak" does not reach 800 hours. When the length of the end region 28*b* corresponding to the welded portion 30 is 1.2 mm, the generation time of an "electrode leak" is 130 hours. Accordingly, a good result has not been obtained in either case.

Meanwhile, when the length of the end region 28*b* corresponding to the welded portion 30 is 0.5 or 1.0 mm, good results have been obtained for both an "electrode leak" and a "foil leak".

FIG. 5C shows the results of the measurement of the generation time of an electrode leak and a foil leak when the length of the first intermediate region 28*a* of the electrode 22 is changed. In this measurement, the first intermediate region 28*a* was a region where the fabrication portions 31 were not formed at all.

The measurement has been performed while the first intermediate region 28*a* is changed when the length of each of the end regions 28*b* and 28*b* is set to 0.5 mm and a metal wire having a diameter of 0.05 mm is wound on all of the second intermediate regions 28*c* and 28*c* with a pitch of 0.15 mm.

When the length of the first intermediate region 28*a* is 0 mm, that is, when the first intermediate region 28*a* is not formed, there is a sample of which the generation time of a "foil leak" does not reach 800 hours. When the length of the first intermediate region 28*a* is 1.2 mm, the generation time of an "electrode leak" is 15 hours. Accordingly, a good result has not been obtained in either case.

Meanwhile, when the length of the first intermediate region 28*a* is 0.5 or 1.0 mm, good results have been obtained for both an "electrode leak" and a "foil leak".

FIG. 5D shows the results of the measurement of the generation time of an electrode leak and a foil leak when the length of the electrode 22 is changed.

The measurement has been performed while the length of the electrode 22 is changed when the length of each of the end regions 28*b* and 28*b* is set to 1.0 mm and a metal wire having a diameter of 0.05 mm is wound on all (4.0 mm) of the first intermediate region 28*a* and the second intermediate regions 28*c* and 28*c* with a pitch of 0.15 mm.

When the length of the electrode 22 is 7.5 mm, there is a sample of which the generation time of a "foil leak" does not reach 800 hours. Accordingly, a good result has not been obtained.

Meanwhile, when the length of the electrode 22 is 8.0 or 8.5 mm, good results have been obtained for both an "electrode leak" and a "foil leak".

As shown in the results of the measurement, if the length of the electrode 22 in the axial direction is set to 8 mm or more, the length of the end region 28*b* corresponding to the protruding portion 29 in the axial direction is set in the range of 0.5 to 1.0 mm, the length of the end region 28*b* corresponding to the welded portion 30 in the axial direction is set in the range of 0.5 to 1.0 mm, and the length of the first intermediate region 28*a* in the axial direction is set in the range of 0.5 to 1.0 mm, it may be possible to stabilize the turning-on state of the discharge lamp 8 and to lengthen the life of the discharge lamp through the prevention of the generation of an electrode leak and a foil leak.

Figure 6:
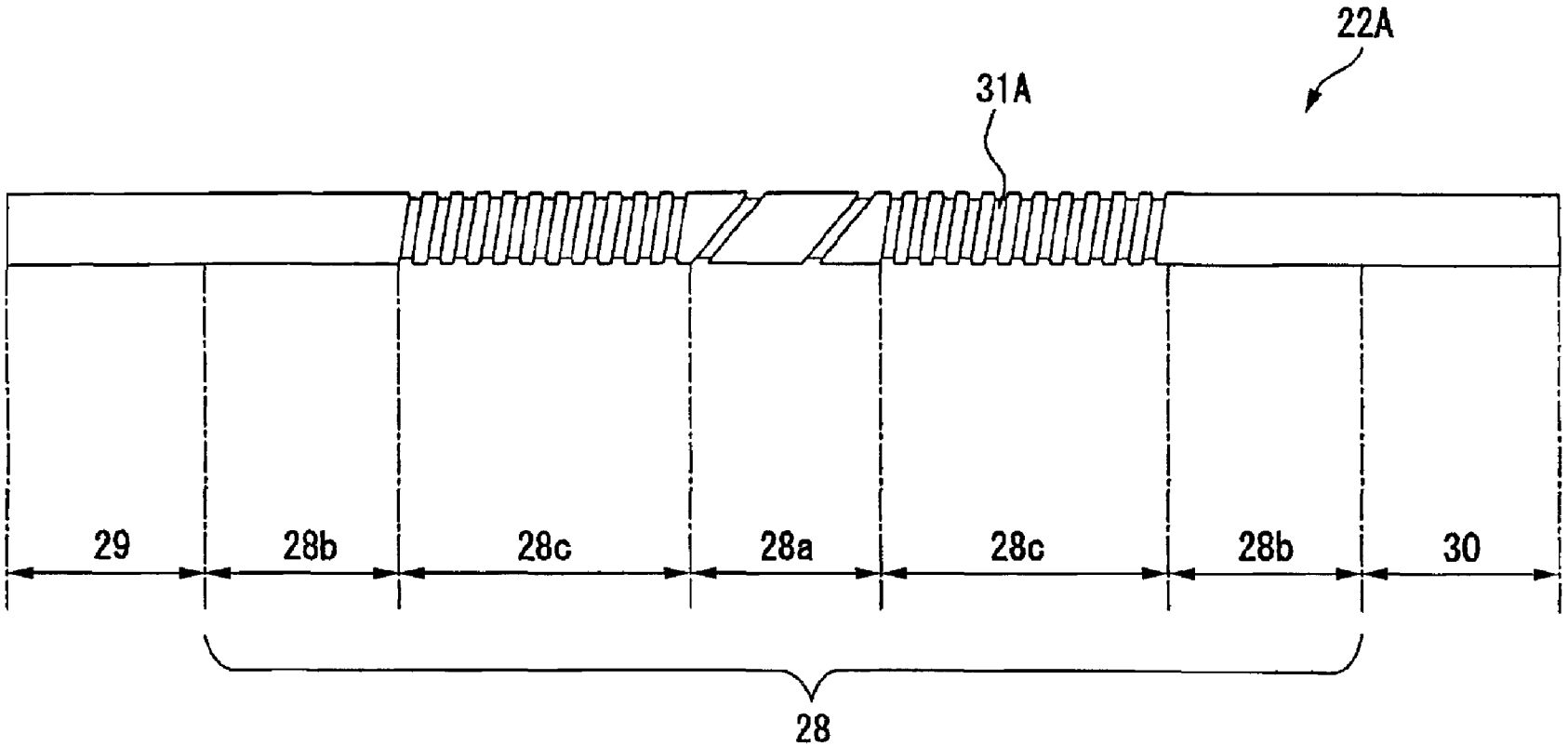
FIG. 6 is an enlarged side view of another example of the electrode.

In the above-mentioned embodiment, the convex fabrication portions 31 have been formed by winding a metal wire on the sealed portion 28 of the electrode 22. However, as shown in FIG. 6, concave fabrication portions 31A having, for example, a spiral shape may be formed by a groove that is formed in a sealed portion 28 of the electrode 22A.

Even though the concave fabrication portions 31A are formed instead of the convex fabrication portions 31, the adhesion of the second intermediate regions 28*c* and 28*c* to the pinch seal portion 21 is low in comparison with a case where a flat electrode adheres to the pinch seal portion 21. Accordingly, it may be possible to suppress the generation of large cracks.

Meanwhile, it may be possible to form the spiral fabrication portions 31A by irradiating an electrode bar having the shape of, for example, a round shaft with laser light so as to form a groove while rotating the electrode bar in a circumferential direction and moving the electrode bar in an axial direction. It may be possible to form the electrode 22 easily by forming the fabrication portions 31 in a spiral shape.

Figure 7:
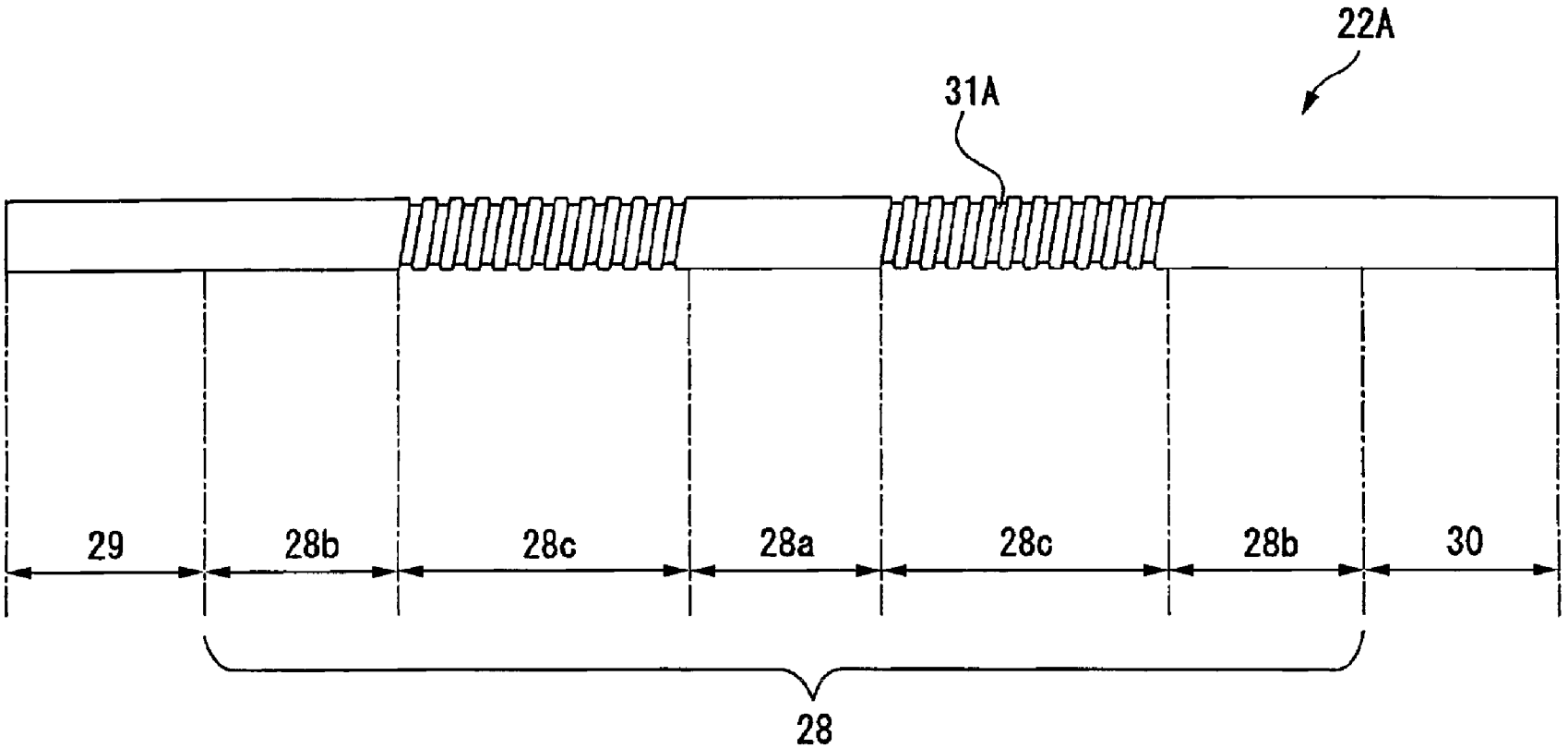
FIG. 7 is an enlarged side view of yet another example of the electrode.

Further, as shown in FIG. 7, fabrication portions 31A may be formed only in second intermediate regions 28*c* and 28*c* and the fabrication portions 31A may not be formed in the first intermediate region 28*a*.

If the fabrication portions 31A are formed only in the second intermediate regions 28*c* and 28*c*, the adhesion of the first intermediate region 28*a* to the pinch seal portion 21 is further improved. Accordingly, it may be improve an advantage of preventing the generation of a foil leak.

Meanwhile, even in the case of an electrode 22 on which the above-mentioned metal wire is wound in the shape of a coil, two metal wires may be wound on the second intermediate regions 28*c* and 28*c*, respectively, so as to form fabrication portions 31 and 31 and the fabrication portions 31 are not formed in the first intermediate region 28*a*.

Although the embodiment according to the present invention has been described above, the present invention is not limited to the above-mentioned embodiments but can be variously modified. Constituent components disclosed in the aforementioned embodiment may be combined suitably to form various modifications. For example, some of all constituent components disclosed in the embodiment may be removed, replaced, or may be appropriately combined with other components.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A vehicular discharge lamp comprising:

an outer tube;

a light emitting tube disposed in the outer tube and is made of quartz glass; and a pair of electrodes disposed in the light emitting tube, wherein the light emitting tube comprises:

a light emitting portion in which mercury-free encapsulated gas comprising noble gas and metal halides is sealed; and a pair of pinch seal portions connected to the light emitting portion on the opposite sides of the light emitting portion, each of the pinch seal portions being sealed with a molybdenum foil, wherein the pair of electrodes comprises:

sealed portions sealed in the pair of pinch seal portions of the light emitting tube;

protruding portions connected to one ends of the respective sealed portions and protrude into the light emitting portion of the light emitting tube; and welded portions connected to the other ends of the respective sealed portions and are welded to the respective molybdenum foils, wherein each of the sealed portions is segmented into:

a first intermediate region positioned in the middle of the electrode in an axial direction;

two end regions configured as both end portions of the sealed portion in the axial direction; and two second intermediate regions positioned between the first intermediate region and the end regions, respectively, wherein concave or convex fabrication portions are formed at least in the second intermediate regions, and wherein a ratio of formation area of the fabrication portions in the first intermediate region to an area of an outer peripheral surface of the first intermediate region is set to be smaller than that of the formation area of the fabrication portions in the second intermediate regions to an area of outer peripheral surfaces of the second intermediate regions, the second intermediate regions include at least three concaves or convexes with a pitch between respective concaves or convexes that is smaller than a pitch between respective concaves or convexes included in the first intermediate region.

2. The vehicular discharge lamp according to claim 1, wherein a length of the electrode in the axial direction is set to be 8 mm or more, wherein a length of the end region corresponding to the protruding portion in the axial direction is set to be in a range from 0.5 mm to 1.0 mm, wherein a length of the end region corresponding to the welded portion in the axial direction is set to be in a range from 0.5 mm to 1.0 mm, and wherein a length of the first intermediate region in the axial direction is set to be in a range from 0.5 mm to 1.0 mm.

3. A vehicular discharge lamp comprising:

an outer tube;

a light emitting tube disposed in the outer tube and is made of quartz glass; and a pair of electrodes disposed in the light emitting tube, wherein the light emitting tube comprises:

a light emitting portion in which mercury-free encapsulated gas comprising noble gas and metal halides is sealed; and a pair of pinch seal portions connected to the light emitting portion on the opposite sides of the light emitting portion, each of the pinch seal portions being sealed with a molybdenum foil, wherein the pair of electrodes comprises:

sealed portions sealed in the pair of pinch seal portions of the light emitting tube;

protruding portions connected to one ends of the respective sealed portions and protrude into the light emitting portion of the light emitting tube; and welded portions connected to the other ends of the respective sealed portions and are welded to the respective molybdenum foils, wherein each of the sealed portions is segmented into:

a first intermediate region positioned in the middle of the electrode in an axial direction;

two end regions configured as both end portions of the sealed portion in the axial direction; and two second intermediate regions positioned between the first intermediate region and the end regions, respectively, wherein concave or convex fabrication portions are formed at least in the second intermediate regions, and wherein a ratio of formation area of the fabrication portions in the first intermediate region to an area of an outer peripheral surface of the first intermediate region is set to be smaller than that of the formation area of the fabrication portions in the second intermediate regions to an area of outer peripheral surfaces of the second intermediate regions, wherein the fabrication portions are formed exclusively at the second intermediate regions.

4. The vehicular discharge lamp according to claim 1, wherein lengths of the two second intermediate regions in the axial direction are set to be equal to each other, wherein lengths of the two end regions in the axial direction are set to be equal to each other, and wherein the center of the first intermediate region in the axial direction is set to match the center of the electrode in the axial direction.

5. The vehicular discharge lamp according to claim 1, wherein a length of the second intermediate regions is greater than a length of the first intermediate region.

* * * * *